United States Patent [19]

Pool

[11] Patent Number: 4,695,006

[45] Date of Patent: Sep. 22, 1987

[54] PAPER CONVERTING MACHINE

[75] Inventor: Daniel L. Pool, Paradise Valley, Ariz.

[73] Assignee: Minnesota Mining and Manufacturing, St. Paul, Minn.

[21] Appl. No.: 764,396

[22] Filed: Aug. 12, 1985

[51] Int. Cl.[4] ..... B65H 35/02

[52] U.S. Cl. ..... 242/56.3

[58] Field of Search ..... 242/56 B, 56.2, 56.3; 83/425.4; 82/93, 100

[56] References Cited

U.S. PATENT DOCUMENTS

| | | | |
|---|---|---|---|
| 129,319 | 7/1872 | Clark | 242/56.3 |
| 1,026,482 | 5/1912 | White | 242/56.3 |
| 1,347,872 | 7/1920 | Pringle | 242/56.3 |
| 2,312,550 | 3/1943 | Hornbostel | 242/56.3 |
| 2,454,003 | 11/1948 | Pamphilon | 242/56.3 |
| 2,526,029 | 10/1950 | Judelson | 242/56.3 |
| 3,096,039 | 7/1963 | Doven | 242/56.2 |
| 3,553,060 | 1/1971 | Waltz | 156/516 |
| 3,950,214 | 4/1976 | Pool et al. | 156/554 X |
| 4,422,588 | 12/1983 | Nowisch | 242/56.3 |

*Primary Examiner*—Stuart S. Levy
*Assistant Examiner*—Joseph J. Hail, III
*Attorney, Agent, or Firm*—Don J. Flickinger; Jordan M. Meschkow

[57] ABSTRACT

A plurality of blades are supported for initially severing a continuous tubular core into a plurality of specialty cores and subsequently slitting a continuous sheet of paper as it is drawn from a bulk roll and wound about the specialty cores. Each blade is replaceably carried by an assembly which is selectively positionable along a bar to provide specialty rolls of coiled paper in predetermined widths. A mandrel upon which the core is carried is provided with a plurality of spaced annular grooves for receiving the cutting edge of each blade.

37 Claims, 11 Drawing Figures

PAPER CONVERTING MACHINE

FIELD OF THE INVENTION

This invention relates to paper handling machinery.

More particularly, the present invention relates to machinery of the type especially adapted for converting paper from bulk quantity rolls into specialty application rolls.

In a further and more specific aspect, the instant invention concerns improvements in the art of slitting and rerolling paper.

THE PRIOR ART

Numerous well-known, commercially available devices function in combination with paper that is coiled or wound into rolls. Exemplary are the dispensing apparatus known as masking machines. Such machines range in size from the large, stationary devices such as described in U.S. Pat. No. 3,553,060, to the compact, manually held devices such as set forth in U.S. Pat. No. 3,950,214.

Masking machines, analogous to other paper utilizing appliances, accommodate rolls of various sizes. Stationary machines, for example, can hold and disperse from a roll of thirty-six inch wide paper, containing one thousand lineal feet of paper. The roll will have a diameter of approximately six and three-fourths inches and a weight of about thirty-one pounds. Relatively small rolls containing one hundred eighty feet of three inch wide paper, being approximately three inches or less in diameter and weighing approximately eight ounces, are frequently required for use in combination with portable masking machines.

Paper, of the type suitable for the foregoing purpose, is supplied by the manufacturer in bulk quantity rolls having a length of sixty inches and a diameter of about forty-two inches. Wound with forty-two thousand lineal feet of sixty inch wide paper, the roll will weigh in excess of one ton. In a process known as converting, the bulk roll is transformed by custom suppliers into specialty rolls.

Machines for converting paper are well-known to those skilled in the art. Commonly, paper converting machines include a base having means for supporting a bulk roll for rotation about a generally horizontal axis. A mandrel is removable supported by the base for rotation about an axis generally parallel to the axis of rotation of the bulk roll. Means are provided for causing rotation of the mandrel and directing the sheet of paper from the bulk roll to the mandrel as the bulk roll rotates and the paper is uncoiled.

The mandrel is sized to closely receive the hollow, hard paper or cardboard cores about which the paper is rewound. In accordance with conventional practice, a plurality of cores are placed upon the mandrel in end-to-end abutment. A plurality of slitting knives intercept the paper sheet intermediate the bulk roll and the mandrel. The knives are spaced to align with the ends of the cores. Generally, several cores of differing lengths are wound simultaneously.

As the machine operates, an individual strip or ribbon of paper is coiled about each core. When the desired quantity of paper has been converted, the machine is stopped, the strips are severed, the mandrel is separated from the machine, and the several specialty rolls removed from the mandrel. In preparation for subsequent operations, a plurality of cores are placed upon the mandrel and the ends of the several strips of paper are affixed, as by tape, to respective cores.

Prior art paper converting machines have not, however, proven to be entirely satisfactory. Loading the plurality of cores upon the mandrel is a laborous, time consuming task further complicated by the fact that a deliberate selection of cores must be made and then arranged upon the mandrel in proper sequence to align with the slitting knives. A further time consuming, tedious task is the attachment of each individual end of ribbon to the respective core.

It is imperative that each knife accurately aligns with the respective abutment of cores. Misalignment of a single knife will result in a core being wound with paper that is overly wide and an adjacent core receiving undersized paper. Since the slitting function occurs at a fixed point along the blade, the blades require frequent resharpening necessitating removal and replacement with the attendant encumbrances associated with realignment.

It would be highly advantageous, therefore, to remedy the foregoing and other deficiences inherent in the prior art.

Accordingly, it is an object of the present invention to provide improvements in paper converting machines.

Another object of the invention is the provision of improvements which will materially reduce the labor associated with the operation of paper converting machines.

And another object of the invention is to provide improvements which will substantially simplify the mechanism and improve the function of a paper converting machine.

Still another object of the instant invention is the provision of means to insure automatic alignment of the slitting blades with the cores.

Yet another object of the invention is to provide simplified means for maintaining the sharpness of the slitting blades.

Yet still another object of this invention is the provision of means whereby the machine may be quickly and easily readjusted to produce alternate sized specialty rolls.

A further object of the invention is to provide means which will ameliorate the loading of the cores upon the mandrel.

Still a further object of the immediate invention is the provision of improved means for slitting and rewinding the paper sheet dispensed from the bulk roll.

Yet a further object of the invention is to provide improvements which will substantially increase the production capacity of paper converting machines.

And a further object of the invention is the provisions, according to the above, which will expedite and reduce the cost of converting paper.

SUMMARY OF THE INVENTION

According to the broad aspect of the invention there is provided an improved paper converting machine of the type which converts a roll of bulk coiled sheet paper into a plurality of specialty rolls of paper wound on specialty cores and which includes a frame, a shaft coupled to the frame and supporting the roll for rotation about a first axis, and a driven roller and an idler forming a cradle therebetween, the improvement comprising a pair of spaced apart arms having first and second ends; an elongate support bar coupled between the spaced apart arms, the support bar having first and second ends, the second ends of the spaced apart arms being coupled to the frame; a plurality of slitter asemblies including slitter blades slideably mounted on the support bar and capable of being selectively positioned thereon at locations corresponding to the desired lengths of the specialty rolls for cutting the bulk coiled sheet paper into the widths as the bulk coiled sheet paper is rolled onto the specialty bars; an elongate shaft having a major cylindrical surface for closely receiving at least one specialty core; and first means for permitting the slitter blades to penetrate the shaft below the major surface.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings in which.

DETAILED DESCRIPTION OF THE PREFERRED EMBODIMENTS

Figures 1, 2, 3, 4:
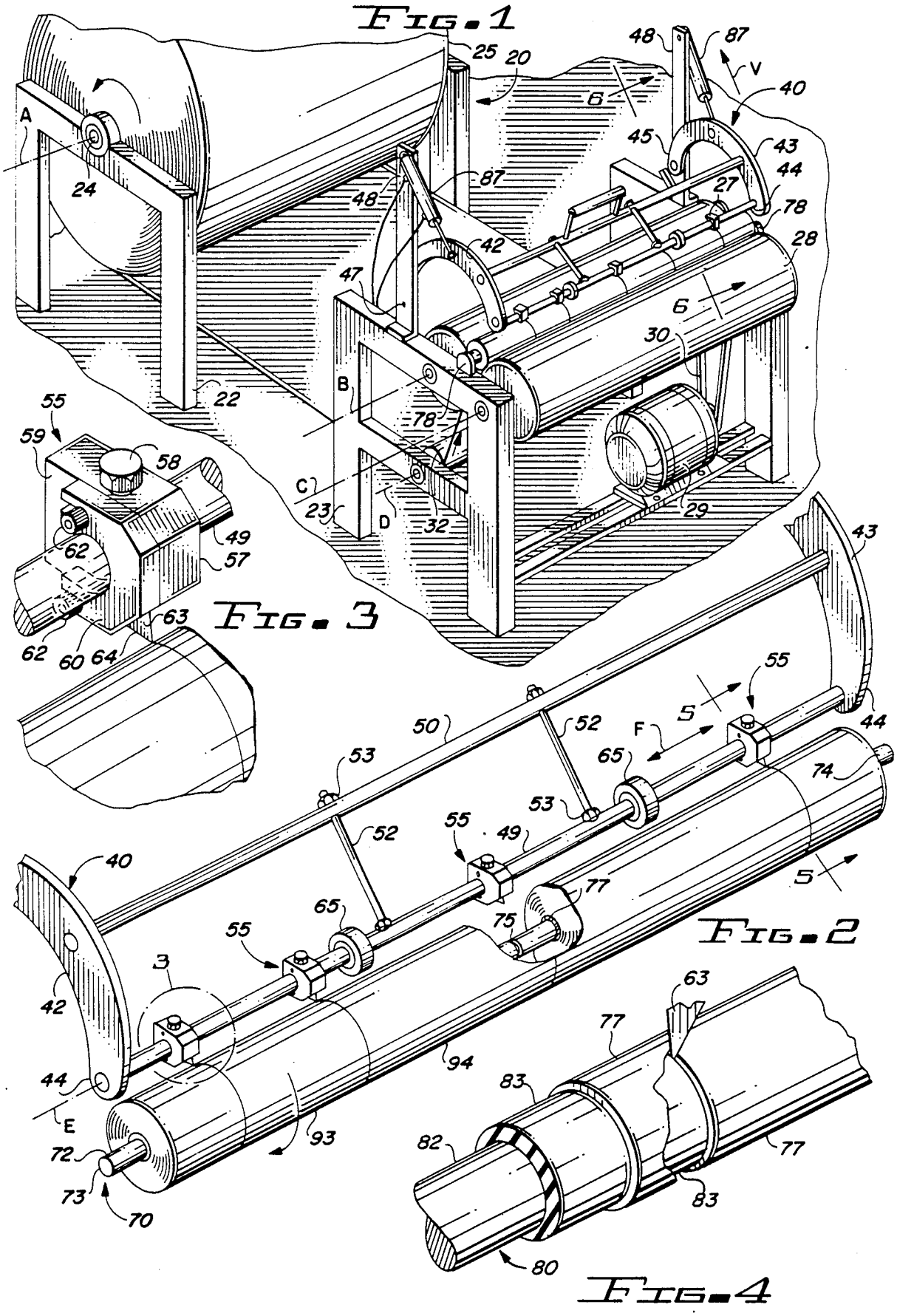
FIG. 1 is a perspective view of a paper converting machine incorporating the improvements of the instant invention.
FIG. 2 is an enlarged, fragmentary, perspective view of a portion of the machine of FIG. 1 and more clearly illustrating the improvements thereof in accordance with a preferred embodiment of the instant invention.
FIG. 3 is an enlarged, fragmentary, perspective view taken from within the area outlined by the broken line circle designated 3 in FIG. 2.
FIG. 4 is a view generally corresponding to the view of FIG. 3 and illustrating an alternate embodiment thereof.

Turning now to the drawings in which like reference characters indicate corresponding elements throughout the several views, attention is first directed to FIG. 1 which illustrates a paper converting machine including a main frame, generally dseignated by the reference character 20 having first and second sub-frames 22 and 23, respectively. Shaft 24, carried by first sub-frame 22, supports roll 25 for rotation about the axis represented by the broken line A. Roll 25 represents a bulk quantity roll of coiled sheet paper as supplied by a manufacturer.

A driven roller 27 and an idler roller 28, carried by second sub-frame 23, are journaled for rotation about the longitudinal axes represented by the broken lines B and C, respectively. Motor 29, carried by second sub-frame 23, imparts rotary motion to driven roller 27 through drive belt 30. Paper guide roller 32, also carried by second sub-frame 23, is journaled for rotation about a longitudinal axis represented by the broken line D. Axes A, B, C and D are mutually parallel.

The paper converting machine described thus far is intended to be generally representative of typical prior art devices of the type. Modifications to the components shown and further and more specific components not illustrated will be readily understood by those skilled in the art. For example, frame 20 may assume various configurations including those in which sub-frames 22 and 23 are integrally joined.

While varying in specific detail, the operation of the various prior art machines is analogous. Rollers 27 and 28 provide a cradle for receiving a mandrel over which has been placed a plurality of specialty cores. The cores, which have been pre-cut, are abutted end-to-end. The free end of the sheet of paper from roll 25 is secured to the several cores. Rotary motion is imparted to the core laden mandrel in response to rotation of roller 27 which is preferably coated with a friction enhancing material, such as rubber. In response thereto, paper is drawn from roll 25 and rewound about the several cores. Intermediate the bulk roll and the specialty cores, the sheet of paper is intercepted by a plurality of blades which slit the paper into selected widths corresponding to the respective cores. It is apparent, the each of the several free ends of the sheet of paper is attached to a respctive core. This operation is generally accomplished by means of an adhesive tape. The paper may also be intercepted by a measuring and counting device to indicate the lineal feet of paper rewound. Also, the device may include tensioning means and a brake to control rotation of roll 25. The device may also include one or more paper guide rolls, such as represented by roller 32, which direct the paper to the cores either from the bottom or over the top.

First provided by the instant invention is an improved slitting mechanism generally designated by the reference character 40. Slitting mechanism 40, as further seen with reference to FIG. 2, includes a pair of spaced apart arcuate arms 42 and 43 each having an end 44 and an end 45 which for purposes of illustration are considered to be the forward end and the rearward end, respectively. Each rearward end 45 is pivotally secured to sub-frame 23 as by pivot pin 47. For receiving ends 45, sub-frame 23 is provided with upright members 48 the further purpose of which will be come apparent as the description ensues.

An elongate support bar 49 extends between and is carried by the forward ends 44 of the arcuate ends 42 and 43. Support bar 49 extends along a longitudinal axis, represented by the broken line E, which is parallel to the previously noted axes A, B, C and D. A reinforcing bar 50 extends between and is carried by arcuate arms 44 and 43 at a location spaced apart from the support bar 49. For simplicity of manufacture, reinforcing bar 50 is parallel to support bar 49. A plurality of spaced apart trusses 52 extend between support bar 49 and reinforcing bar 50. Preferably, for purposes of providing adjustable alignment, each truss 52 is of selectively adjustable effective length. For this purpose, each end of each truss is threadedly engaged with the respective bar and secured by a lock nut 53.

A plurality of slitter assemblies, each generally designated by the reference character 55, are carried upon support bar 49. Each slitter assembly 55, as better seen in FIG. 3, includes a block 57 which is slideably movable upon bar 49 in directions indicated by the double arrowed line F. For this purpose, black 57 is provided with a bore (not specifically illustrated), through which bar 49 is closely received. Set screw 58, threadedly engaged within block 57 and tightenable against bar 49 in accordance with conventional procedure, provides for retaining assembly 55 at a selected location along bar 49.

Carried by block 57 is face 59 to which is secured clamping element 60 by screws 62. Preferably, clamping element 60 is generally U-shaped to accommodate support bar 49 and a screw 62 resides proximate either end thereof. Block 59 and element 60, along with screws 62, function as clamping means for holding slitting blade 63.

In accordance with a preferred embodiment of the instant invention, slitting blade 63 is a portion of a conventional commercially available razor blade. Blade 63 is oriented such that the cutting edge 64 extends rearwardly downward. Each razor blade provides two sections 63. Such blades have an entirely satisfactory service life. Being exceedingly inexpensive, such blades are considered to be disposable thereby eliminating the need for resharpening. Since the blade is held against face 59, the position of which is not altered during changing of the blades, alignment problems are nonexistent.

Slitting mechanism 40 is readily usable in connection with prior art paper converting machines. During set-up, the blade 63 of each slitter assembly 55 is aligned with the respective naturally occurring groove between abutting adjacent cores. A plurality of rollers 65 carried upon support bar 49 initially abut the core and subsequently the outer layer of coiled paper to maintain the axis E at a given distance from the material to be cut. Slitter assemblies 55 are rotatable about support bar 49. Accordingly, the top of blade 63 being eccentric relative axis E, is readily adjustable for penetration depth. Similarly, any selected slitter assembly 55 may be withdrawn from service either as a result of removing blade 63 or rotating the slitter assembly to a position in which the blade 63 is remote from the core and paper. Further description of slitter mechanism 40 will be set forth presently.

A further improvement of the instant invention, especially devised to cooperate with slitting mechanism 40 is an improved mandrel 70 as best viewed in FIG. 2. In accordance with the immediately preferred embodiment thereof, mandrel 70 includes an elongate shaft 72, such as a steel rod, having ends 73 and 74. A plurality of external annular groves 75 are formed into shaft 72.

Shaft 72 has a diameter which is sized to closely receive a standard core 77 upon which the paper is wound during the manufacture of a specialty roll. Such cores are generally fabricated of hard paper or cardboard. The grooves 75 are spaced apart to coincide with the incremental lengths of standard specialty rolls. For example, if it is desired to produce rolls which vary in length by three inch increments, (i.e., three inches, six inches, nine inches, etc.), the grooves 75 ar spaced three inches apart. It will be appreciated, that the grooves may be spaced apart any selected distance. In contrast to prior art mandrels, mandrel 70 is especially adapted to receive a single continuous core having a length corresponding to the width of the sheet of paper drawn from roll 25. During operation, of which further description will be made presently, mandrel 70 is cradled between rollers 27 and 28 as previously described and held in longitudinal alignment between thrust bearing elements 78 carried by second sub-frame 23. Although only one thrust bearing element 78 for receiving end 73, is specifically illustrated, it will be appreciated that a similar thrust bearing element 78 exists for receiving end 74.

With reference to FIG. 4, there is seen an alternate mandrel generally designated by the reference character 80. In general similarity to previously described mandrel 70, mandrel 80 includes an elongate shaft 82 having ends as previously described. Having a diameter somewhat smaller than shaft 72, shaft 82 is coated with a layer of readily cutable material 83 the outer diameter of coating 83 is of a size to closely receive continuous core 77.

In the following description of the operation and function of the previously described improvements, mandrel 70 has been chosen for purposes of illustration. It will be appreciated, however, that the description is also applicable to the mandrel designated by the reference character 80.

Figure 5:
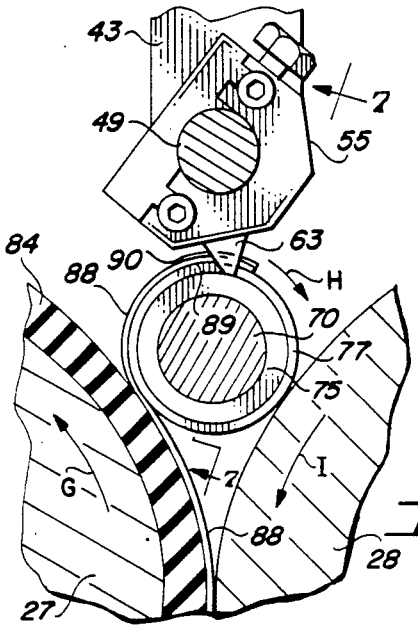
FIG. 5 is an enlarged, fragmentary, vertical, sectional view taken along the line 5—5 of FIG. 6.
Figure 7:
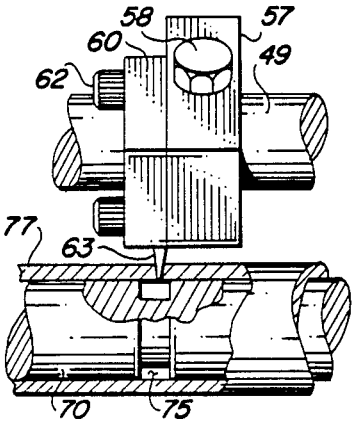
FIG. 7 is a fragmentary, vertical, sectional view taken along the line 7—7 of FIG. 5 and ilustrating the device thereof as it would appear during an initial stage of operation.
Figure 6:
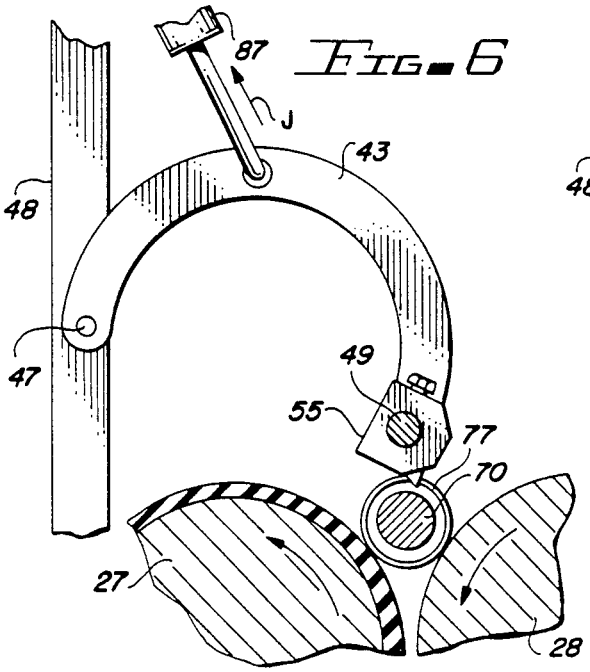
FIG. 6 is an enlarged, fragmentary, vertical, sectional view taken along the line 6—6 of FIG. 1.

Turning now to FIGS. 5, 6 and 7, there is seen mandrel 70 as it would appear when encased by core 77 and cradled by driven roller 27 and idler roller 28. For purposes of illustration, it is assumed that driven roller 27, as a result of the motion imparted by motor 29, rotates in the direction indicated by the arrowed line G thereby imparting motion to mandrel 70 in the direction indicated by the arrowed line I. To enhance the frictional contact between core 77, and subsequently the paper coiled thereabout, and thereby insure the rotation of mandrel 70, driven roller 27 is coated with a frictional enhancing material such as rubber coating 84.

During initial set-up, the several slitter assemblies 55 are spaced along support bar 49 such that the distances between slitting blades 63 correspond to the desired lengths of specialty rolls to be produced. It is noted that an assortment of lengths may be produced simultaneously. Each individual slitter assembly 55 is also adjusted such that with the rollers 65 abutting core 77, the tips of the several slitting blades 63 penetrate into a respective groove 75. Alternately, when mandrel 80 is utilized, the blades 63 are adjusted to penetrate the surface of coating 83. In either case, for purposes of preservation of blade 63, contact with metal is prohibited.

With momentary reference to FIG. 1, it is seen that a pair of hydraulic cylinder assemblies 87 are associated with slitting mechanism 40. Mounted in accordance with standard practice in the art, one end of each assembly 87 is pivotally secured to the respective upright member 48 while the other end is pivotally secured to the respective arcuate arm 42 and 43. Being conventional commercially available devices of the type, which may be energized by a manual switch or an automatic switch energized in response to the paper counter, the hydraulic cylinder assemblies cooperate to lift arms 42 and 43 and the elements associated therewith in a direction indicated by the arrowed line J. Preferably, the terminus of the lifting action of hydraulic cylinder assemblies 87 is sufficient to place slitter assemblies 55 at a sufficiently remote location to allow the hands of the operator unobstructed access to the mandrel, the core and the paper wound thereabout.

At commencement of operation, in accordance with a preferred method thereof, cylinder assemblies 87 are activated to lift support bar 49 and the associated slitter assemblies 55 to the remote position. Mandrel 70, with a single continuous core 77 engaged therewith, is cradled between rollers 27 and 28 with a sheet of paper 88 from roll 25 extending between driven roller 27 and core 77. The free end 89 of sheet 88 is then secured to core 77 as by a strip of adhesive tape 90 over lying end 89 and the core 77. The hydraulic cylinder assemblies 87 are then relaxed, allowing arms 42 and 43 to fall positioning each blade 63 against the core 77 at a location forward of tape 90 with respect to the arrowed line H. Motor 29 is then energized imparting rotary motion to driven roller 27 and the associated mandrel and core 70 and 77, respectively.

It is noted that each blade 63 contacts core 77 at a point forward of center with respect to the direction of rotation. In other words, each blade 63 is slightly on the downhill side of the cylinder cross-section. It is also noted that the pivot points 47 reside at a higher location than the point of contact between the blades 63 and the core 77. Accordingly, in response to rotation, each blade 63 is immediately drawn into core 77 in order to slit the free end 89 of paper sheet 88 and to sever the continuous core 77 into the predetermined lengths for the specialty rolls. It is also noted that this arrangement allows that the free end 89 presents a single continuous edge which may be secured to the single continuous core 77 by a single continuous strip of tape. This is in contrast to the corresponding initial step of the prior art in which all of the elements are segmental.

Figure 8:
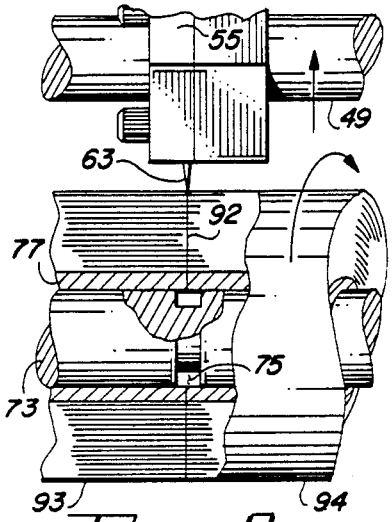
FIG. 8 is an enlarged view generally corresponding to the view of FIG. 7 and illustrating the embodiment as it would appear during a subsequent stage of operation.
Figure 9:
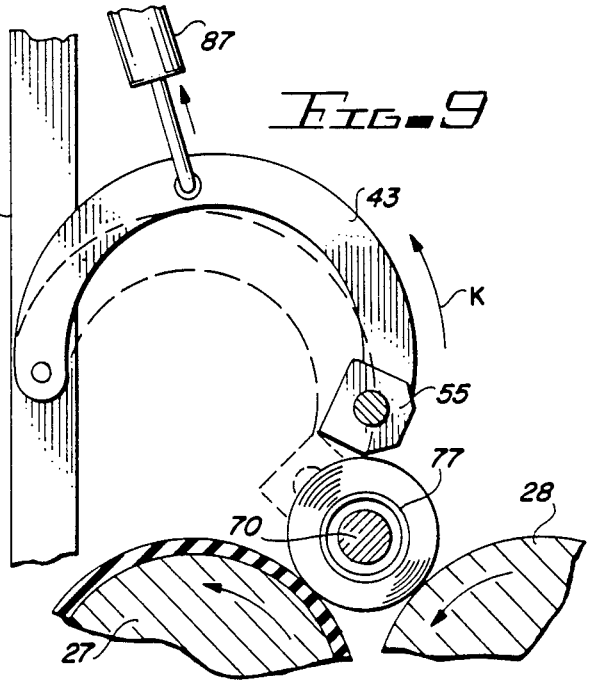
FIG. 9 is a view generally corresponding to the view of FIG. 6 and taken at a time corresponding to the phase of operation illustrated in FIG. 8.

As the converting operation nears completion, the previously described elements and components assume the configuration and relationship especially seen in FIGS. 8 and 9. As each successive coil of paper is wound about core 77, rollers 65 are continuously lifted urging the slitter assemblies in the direction of arrowed line K. This situation is particularly dramatized in FIG. 9 wherein arm 43 shown in the solid outline represents the lifted position having moved upwardly from the initial position as shown in broken outline. During movement, the cutting edge of each blade 63 moved in a direction perpendicular to the longitudinal axis of mandrel 70. Accordingly, the slitting of core 77 and the paper sheet 88 was accomplished along a line 92 as especially seen in FIG. 8. The line 92 also represents the abutting ends of adjacent specialty rolls 93 and 94. It is immediately apparent from viewing FIG. 8 that the end of each specialty roll is perpendicular to the axis of the core and that alignment of the slit paper with the respective specialty core is automatically achieved. FIG. 2 further illustrated a plurality of differing length specialty cores having been simultaneously produced.

In preparation for the final operations, arms 42 and 43 are lifted to the terminal position. Thereafter, the operation is completed in a manner analogous to prior art practices. Briefly, sheet 88 is severed from the several specialty rolls. The free end of each specialty roll is secured with tape or other convenient means. Mandrel 70 is removed from the machine the several specialty rolls are removed from the mandrel and the operation is repeated.

Figure 10:
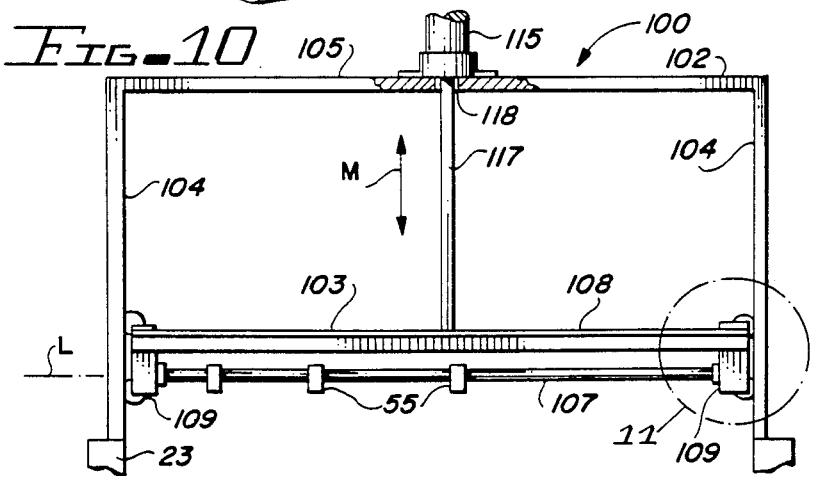
FIG. 10 is a front elevation view of an alternate embodiment of the instant invention, portions thereof being broken away for purposes of illustration.

FIG. 10 illustrates an alternate embodiment of a slitter assembly embodying the principles of the instant invention and generally designated by the reference character 100. Usable in ways and means previously described in connection with slitting mechanism 40, slitting mechanism 100 includes frame 102 upon which is movable mounted carriage 103. Frame 102 includse a pair of spaced apart substantially parallel side members 104 extending upwardly from second sub-frame 23 and joined at the upper free ends by transverse member 105. Carriage 103 includes elongate support bar 107 and elongate reinforcing bar 100, the extremities of which are joined by trucks 109. Support bar 107 extends transverse of the paper converting machine along an axis represented by the broken line L which is substantially aligned with and analogous to the previously described axis E.

Figure 11:
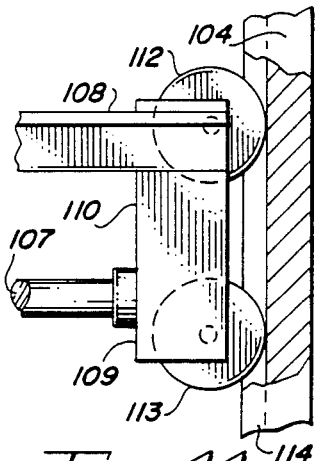
FIG. 11 is an enlarged, fragmentary portion taken from within the broken outline area designated 11 and having portions thereof broken away for clarity of illustration.

Each truck 109, as further seen in FIG. 11, includes a chassis portion 110, to which are secured the bars 107 and 108, and a pair of rollers 112 and 113. Rollers 112 and 113, which are carried in spaced apart relationship by chassis portion 110, are journaled for rotation about respective axes which are generally perpendicular to the axis L. A groove 114, extending longitudinally within each side member 104, functions as a track for receiving each set of wheels 112 and 113 and guiding the movement of each truck 109.

A conventional commercially hydraulic cylinder assembly 115 is mounted upon transverse member 105. Operating rod 117 of hydraulic cylinder assembly 115 passes through opening 118 in transverse member 105 and is affixed to reinforcing bar 108. Accordingly, carriage 103 is reciprocally movable within frame 102 in directions indicated by the double arrowed line M. A plurality of slitter assemblies 55 are carried upon support bar 107. Except for the fact that carriage 103 moves in lineal directions whereas arms 42 and 43 move in rotational directions, slitting mechanism 100 is the functional equivalent of previously described slitting mechanism 40.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described and disclosed the present invention, and alternately preferred embodiments thereof, in such clear and concise terms as to enable those skilled in the art to understand and practice the same, the invention claimed is:

1. A slitter mechanism for use in a paper converting machine which converts a roll of bulk coiled sheet paper into a plurality of specialty rolls of paper, said machine being of the type which includes a frame, a shaft coupled to the frame and supporting said roll of bulk coiled sheet paper for rotation about a first axis, a driven roller, an idler roller, and a mandrel positioned for rotation in a cradle formed by said driven roller and said idler roller for receiving a plurality of pre-cut specialty cores positioned in end-to-end abutment relationship upon which paper cut from said roll of bulk coiled sheet paper is wound in widths corresponding to the length of each of said specialty cores, said slitter mechanism comprising:

a pair of spaced apart arms having first and second ends;

an elongate support bar coupled between said spaced apart arms, said support bar having first and second ends, the second ends of said spaced apart arms being coupled to said frame;

a plurality of slitter assemblies slideably mounted on said support bar and capable of being selectively positioned thereon at locations corresponding to the desired lengths of said specialty rolls for cutting said bulk coiled sheet paper into said widths as said bulk coiled sheet paper is rolled onto said specialty cores;

a reinforcing bar extending between and carried by said pair of spaced apart arms at a location apart from said support bar and intermediate the first and second ends of said spaced apart arms; and a plurality of spaced apart trusses each having a selectively adjustable length extending between and threadably engaging said support bar and said reinforcing bar.

2. A mechanism according to claim 1 wherein each truss is secured by a lock-nut.

3. A mechanism according to claim 1 further comprising first means for maintaining said support bar at given distance from the outer surface of said specialty rolls on said mandrel.

4. A mechanism according to claim 3 wherein said first means comprises at least one roller carried by said support from which rollingly engages the outer surface of said specialty rolls.

5. A mechanism according to claim 1 wherein each of said slitter assemblies comprises:

a block having a bore therethrough for closely receiving said support bar;

tightening means for fixing the location of said block on said support bar;

clamping means coupled to said block; and a slitting blade removably secured to said block by said clamp.

6. A mechanism according to claim 5 wherein said tightening means comprises a set screw which threadably engages said block and is tightenable against said support bar.

7. A mechanism according to claim 5 wherein said clamp is coupled to said block by screws.

8. A mechanism according to claim 5 wherein said clamp is U-shaped to accommodate said support bar.

9. A mechanism according to claim 5 wherein said slitting blade is a razor blade.

10. A mechanism according to claim 9 wherein said slitting blade has a cutting edge which extends rearwardly downward.

11. A mechanism according to claim 5 wherein the slitter assemblies are aligned with the edges of abutting adjacent cores for cutting the bulk sheet paper into strips which are wound respectively on said cores.

12. A mechanism according to claim 5 wherein said pair of spaced apart arms are arcuate, said first and second ends being forward and rearward ends respectively, said rearward ends pivotally coupled to said frame.

13. A mechanism according to claim 12 wherein said pair of spaced apart arms are pivotably coupled to said frame by means of pivot pins.

14. A mechanism according to claim 12 wherein said frame is provided with first and second upright members having upper ends to which the rearward ends of said spaced apart arms are pivotably coupled.

15. A mechanism according to claim 14 further comprising first hydraulic means for coupling the rearward ends of said spaced apart arms to the upper ends of said first and second upright members so as to permit said support arm to be moved from an operational position adjacent said mandrel to a non-operational position away from said mandrel.

16. A mechanism according to claim 5 wherein said pair of spaced apart arms are substantially parallel and extend upwardly from said frame and further comprising a transverse member fixedly coupled to the first ends of said pair of spaced apart arms.

17. A mechanism according to claim 16 wherein the extremities of said support bar and said reinforcing bar are joined by trucks which roll along said pair of spaced apart arms.

18. A mechanism according to claim 17 wherein each of said spaced apart arms have a longitudinal track therein for receiving one of said trucks.

19. A mechanism according to claim 18 wherein each truck comprises:

a chassis to which said support bar and said reinforcing bar are fixedly coupled; and a pair of wheels carried by said chassis in spaced apart relationship, said wheels received by said track for guiding the movement thereof.

20. A mechanism according to claim 19 further comprising second hydraulic means coupled to said reinforcing bar to impart reciprocal movement to said reinforcing bar and said support bar.

21. An improved paper converting machine of the type which converts a roll of bulk coiled sheet paper into a plurality of specialty rolls of paper wound on specialty cores and which includes a frame, a shaft coupled to the frame and supporting said roll for rotation about a first axis, and a driven roller and an idler forming a cradle therebetween, the improvement comprising:

a pair of spaced arms having first and second ends;

an elongate support bar coupled between said spaced apart arms, said support bar having first and second ends, said second of said spaced apart arms being coupled to said frame;

a plurality of slitter assemblies including slitter blades slideably mounted on said support bar and capable of being selectively positioned thereon at locations corresponding to the desired lengths of said specialty rolls for cutting said bulk coiled sheet paper into said widths as said bulk coiled sheet paper is rolled onto said specialty cores;

an elongate shaft having a major cylindrical surface for closely receiving at least one specialty core;

first means for permitting said slitter blades to penetrate said shaft below said major surface; and a reinforcing bar extending between and carried by said pair of spaced apart arms at a location apart from said support bar and intermediate the first and second ends of said spaced apart arms; and a plurality of spaced apart trusses each having a selectively adjustable length extending between and threadably engaging said support bar and said reinforcing bar.

22. A machine according to claim 21 further comprising first means for maintaining said support bar at a given distance from the outer surface of said specialty rolls on said mandrel.

23. A machine according to claim 21 wherein each of said slitter assemblies comprises:

a block having a bore therethrough for closely receiving said support bar;

tightening means for affixing the location of said block on said support bar; and clamping means coupled to said block removably securing said slitting blade to said block.

24. A machine according to claim 23 wherein said tightening means comprises a set screw which threadably engages said block and is tightenable against said support bar.

25. A machine according to claim 23 wherein said slitting blade is a razor blade.

26. A machine according to claim 25 wherein said slitting blade has a cutting edge which extends rearwardly downward.

27. A machine according to claim 23 wherein said pair of spaced apart arms are arcuate, said first and second ends being forward and rearward ends respectively, said rearward ends pivotally coupled to said frame.

28. A machine according to claim 27 wherein said frame is provided with first and second upright members having upper ends to which the rearward ends of said spaced apart arms are pivotably coupled.

29. A machine according to claim 28 further comprising first hydraulic means for coupling the rearward ends of said spaced apart arms to the upper ends of said first and second upright members so as to permit said support bar to be moved from an operational position adjacent mandrel to a nonoperative position away from said mandrel.

30. A machine according to claim 23 wherein said pair of spaced apart arms are substantially parallel and extend upwardly from said frame and further comprising a transverse member fixedly coupled to the first ends of said pair of spaced apart arms.

31. A machine according to claim 30 wherein the extremities of said support bar and said reinforcing bar are joined by trucks which roll along said pair of spaced apart arms.

32. A machine according to claim 31 wherein each of said spaced apart arms has a longitudinal track therein for receiving one of said trucks.

33. A machine according to claim 32 wherein each of said trucks comprises:

a chasis to which said support bar and said reinforcing bar are fixedly coupled; and a pair of wheels carried by said chassis in spaced apart relationship, said wheels received by said track for guiding the movement thereof.

34. A machine according to claim 23 further comprising second hydraulic means coupled to said reinforcing bar to impart reciprocal movement to said reinforcing bar and said support bar.

35. A machine according to claim 21 wherein said first means includes an outer layer of readily cutable material.

36. A machine according to claim 21 wherein said first means comprises a plurality of annular grooves in said shaft for receiving said blades.

37. A machine according to claim 36 wherein said plurality of annular grooves coincides with incremental lengths of specialty rolls.

* * * * *